US005720678A

United States Patent [19]

Korthauer

[11] Patent Number: 5,720,678

[45] Date of Patent: Feb. 24, 1998

[54] INFLATABLE BARRIER FOR SPORTS GAMES

[76] Inventor: Sue Korthauer, 2434 Lake Village Dr., Kingwood, Tex. 77339

[21] Appl. No.: 676,646

[22] Filed: Jul. 11, 1996

[51] Int. Cl.[6] ..... A63B 71/02

[52] U.S. Cl. ..... 473/415

[58] Field of Search ..... 273/411; 473/196, 473/415

[56] References Cited

U.S. PATENT DOCUMENTS

| | | | |
|---|---|---|---|
| 3,190,657 | 6/1965 | Johnson | 473/196 |
| 3,986,342 | 10/1976 | MacCracken | 62/66 |
| 4,815,153 | 3/1989 | Bleser et al. | 5/98 R |
| 4,815,301 | 3/1989 | Deloughery | 62/235 |

OTHER PUBLICATIONS

Border Patrol News, vol. 1, Issue 2, Published Sep. 1995, Cover Page.

Border Patrol News, vol. 2, Issue 5, Published Jun. 1996, Cover Page.

Border Patrol News, vol. 2, Issue 5, Published Jun. 1996, Backside of Cover Page.

*Primary Examiner*—William H. Grieb

*Attorney, Agent, or Firm*—Kenneth A. Roddy

[57] ABSTRACT

A hollow inflatable barrier for sports games formed of flexible air impervious material is supported on a generally flat surface to form a continuous configuration of sufficient size and shape to surround the perimeter of a game playing area. A fan or blower connected by a conduit in fluid communication with the hollow barrier conducts air into the hollow barrier to inflate it. In the inflated condition the barrier forms a perimeter barrier surrounding the game playing area to bar passage of small objects traveling across the generally flat surface. In a preferred embodiment the inflatable barrier is formed of a plurality of elongate hollow tubular members releasably joined end-to-end to form the continuous configuration. The tubular members may be provided in various shapes including straight for forming straight sections of the barrier, and straight with angled ends or curved for forming the corners of the barrier. The barrier may also have elongate tubular members with inflatable tubular column members joined thereto in fluid communication which extend outwardly and upwardly therefrom in an inflated condition with a length of netting material extending between the column members.

19 Claims, 4 Drawing Sheets

INFLATABLE BARRIER FOR SPORTS GAMES

BACKGROUND OF THE INVENTION

1. Field of the Invention

This invention relates generally to inflatable barriers, and more particularly to an inflatable barrier for sports games which is supported on a generally flat surface and surrounds the playing area and prevents the puck, ball or other small object from leaving the area. It is particularly suited for outdoor games such as roller hockey or field hockey.

2. Brief Description of the Prior Art

Many sports games are played on an open field, wherein opposing teams attempt to drive a ball, puck, or other small object into or through the goal of the opponent. Popular games of this type include ice hockey which is played indoors on an ice rink or outdoors on a frozen body of water, field hockey which is played outdoors on an open field, and roller hockey which is played on a hard surface such as a paved street or parking lot with players wearing roller skates. Roller hockey has become an increasingly popular sport due to the advent of "in-line" roller skating. There is now an association known as the "National In-line Hockey Association" (N.I.H.A.) which regulates and promotes "In-line Hockey", and many other organizations and clubs which sponsor "In-line Hockey" games and tournaments.

Although the personal equipment, such as skates, helmets and protective pads used in sports games have been improved, technical advances in the related field equipment have lagged behind the growth and popularity of sports games, such as roller hockey and other games, which are played on a paved surface, open field, or frozen body of water.

One of the main problems associated with games which are played on a paved surface, open field, or frozen body of water, is that the ball, puck, or other small object which is used in the game play will very often be driven out of the playing area. This sometimes results in loosing the ball, puck, or other small object or in spending time to retrieve the object. Another major problem associated with the ball, puck, or other small object leaving the playing area, is that it travels at a high rate of speed and may strike and injure onlookers which may be standing or sitting around the perimeter of the playing area.

Others have attempted to construct barriers to overcome these problems. For example, it is now the current practice, in in-line hockey games, to surround the playing area with a plurality of wooden barricade panels. These wooden panels are approximately 6–8 feet long and about 4 feet tall and are placed end-to-end around the playing area. The wooden barricades are heavy and cumbersome and require a large truck or several smaller trucks to transport them to the playing site. They also require a great deal of time and manpower to unload and erect them before a game and to disassemble and reload them after the game. The wooden barriers also occupy a large storage area when not in use.

In-Line Sports Systems, Inc., of Minneapolis, Minn. has recently introduced a portable rink system for in-line hockey known as the "Border Patrol" which comprises a plurality of rectangular barriers placed end-to-end around the playing area. The "Border Patrol" barriers are elongate members formed of plastic foam covered with canvas material. These barriers are large and cumbersome and require a large truck or several smaller trucks to transport them to the playing site. They also require a great deal of time and manpower to unload and erect them before a game and to disassemble and reload them after the game. They also occupy a large storage area when not in use.

In-Line Sports Systems, Inc., of Minneapolis, Minn. has also recently introduced an inflatable rink system which was developed by the National Hockey League (NHL) for in-line hockey known as the "COOLAir" (tm) Arena System. The "COOLAir" (tm) system comprises a rectangular barrier which surrounds the the playing area. The "COOLAir" (tm) barrier, when inflated, is about 4 feet tall and resembles a large elongate air mattress supported on its side and it has upstanding air filled columns with nets supported between the columns. This barrier is large and requires four blowers to maintain the inflated condition. Its height and construction makes it vunerable to catching gusts of wind and bending or falling over.

There are several patents which disclose various inflatable barriers and barriers for sports games.

MacCracken, U.S. Pat. No. 3,986,342 discloses a method for securing dasher boards used in ice hockey around the perimeter of an ice rink wherein ice is frozen as a continuous slab extending about a foot behind the dasher boards which are supported on cantilever posts that provide bonding with the ice.

Deloughery, U.S. Pat. No. 4,815,301 discloses a portable ice skating rink having a liner with inflatable end portions capable of being raised to a rectangular position relative to the liner, and rink blocks having a main body containing a cavity capable of receiving the end portions through a slotted opening, and means for interconnecting the rink blocks, and when inflated the end portions press against the sides of the cavity and form a watertight seal, and means for interconnecting the rink blocks.

Bleser et al, U.S. Pat. No. 4,815,153 discloses an inflatable play pen having an interconnected mattress portion, and upper ring portion supported atop spaced apart column portions with netting extending between the portions.

Inflatable oil booms having generally tubular configurations are also known in the art, but are not particularly suited for use as a barrier for sports games.

The present invention is distinguished over the prior art in general, and these patents in particular by a hollow inflatable barrier for sports games formed of flexible air impervious material which is supported on a generally flat surface to form a continuous configuration of sufficient size and shape to surround the perimeter of a game playing area. A fan or blower connected by a conduit in fluid communication with the hollow barrier conducts air into the hollow barrier to inflate it. In the inflated condition the barrier forms a perimeter barrier surrounding the game playing area to bar passage of small objects traveling across the generally flat surface. In a preferred embodiment the inflatable barrier is formed of a plurality of elongate hollow tubular members releasably joined end-to-end to form the continuous configuration. The tubular members may be provided in various shapes including straight for forming straight sections of the barrier, and straight with angled ends or curved for forming the corners of the barrier. The barrier may also have elongate tubular members with inflatable tubular column members joined thereto in fluid communication which extend outwardly and upwardly therefrom in an inflated condition with a length of netting material extending between the column members.

SUMMARY OF THE INVENTION

It is therefore an object of the present invention to provide an inflatable barrier for sports games which is easily and quickly deployed to form a continuous configuration of size and shape to surround the perimeter of a game playing area and prevent the puck, ball, or other small object from leaving the playing area, and is quickly and easily removed.

It is another object of this invention to provide an inflatable barrier for sports games which is lightweight and flexible, and easily transported and stored in a small space.

Another object of this invention is to provide an inflatable barrier for sports games which is erected from a plurality flat, flexible, lightweight hollow members which are easily and quickly unrolled or unfolded from a deflated stored condition and joined end-to-end and inflated to form a continuous tubular configuration which surrounds the playing area.

Another object of this invention is to provide an inflatable barrier for sports games which is formed of a plurality of tubular members which in their deflated and unassembled condition, are flat, flexible, and lightweight and may be rolled up like a fire hose, or may be folded to form a series of small compact units which are easily transported in the trunk of an automobile or small pickup truck and occupy a small area when stored.

A further object of this invention is to provide an inflatable barrier for sports games which may be provided with a net arrangement at each end or at other locations for catching a puck, ball or other small object which may be propelled into the air.

A still further object of this invention is to provide a an inflatable barrier for sports games which is simple in design and construction, economical to manufacture, and rugged and durable in use.

Other objects of the invention will become apparent from time to time throughout the specification and claims as hereinafter related.

The above noted objects and other objects of the invention are accomplished by a hollow inflatable barrier for sports games formed of flxible air impervious material which is supported on a generally flat surface to form a continuous configuration of sufficient size and shape to surround the perimeter of a game playing area. A fan or blower connected by a conduit in fluid communication with the hollow barrier conducts air into the hollow barrier to inflate it. In the inflated condition the barrier forms a perimeter barrier surrounding the game playing area to bar passage of small objects traveling across the generally flat surface. In a preferred embodiment the inflatable barrier is formed of a plurality of elongate hollow tubular members releasably joined end-to-end to form the continuous configuration. The tubular members may be provided in various shapes including straight for forming straight sections of the barrier, and straight with angled ends or curved for forming the corners of the barrier. The barrier may also have elongate tubular members with inflatable tubular column members joined thereto in fluid communication which extend outwardly and upwardly therefrom in an inflated condition with a length of netting material extending between the column members.

DESCRIPTION OF THE PREFERRED EMBODIMENT

Figure 1:
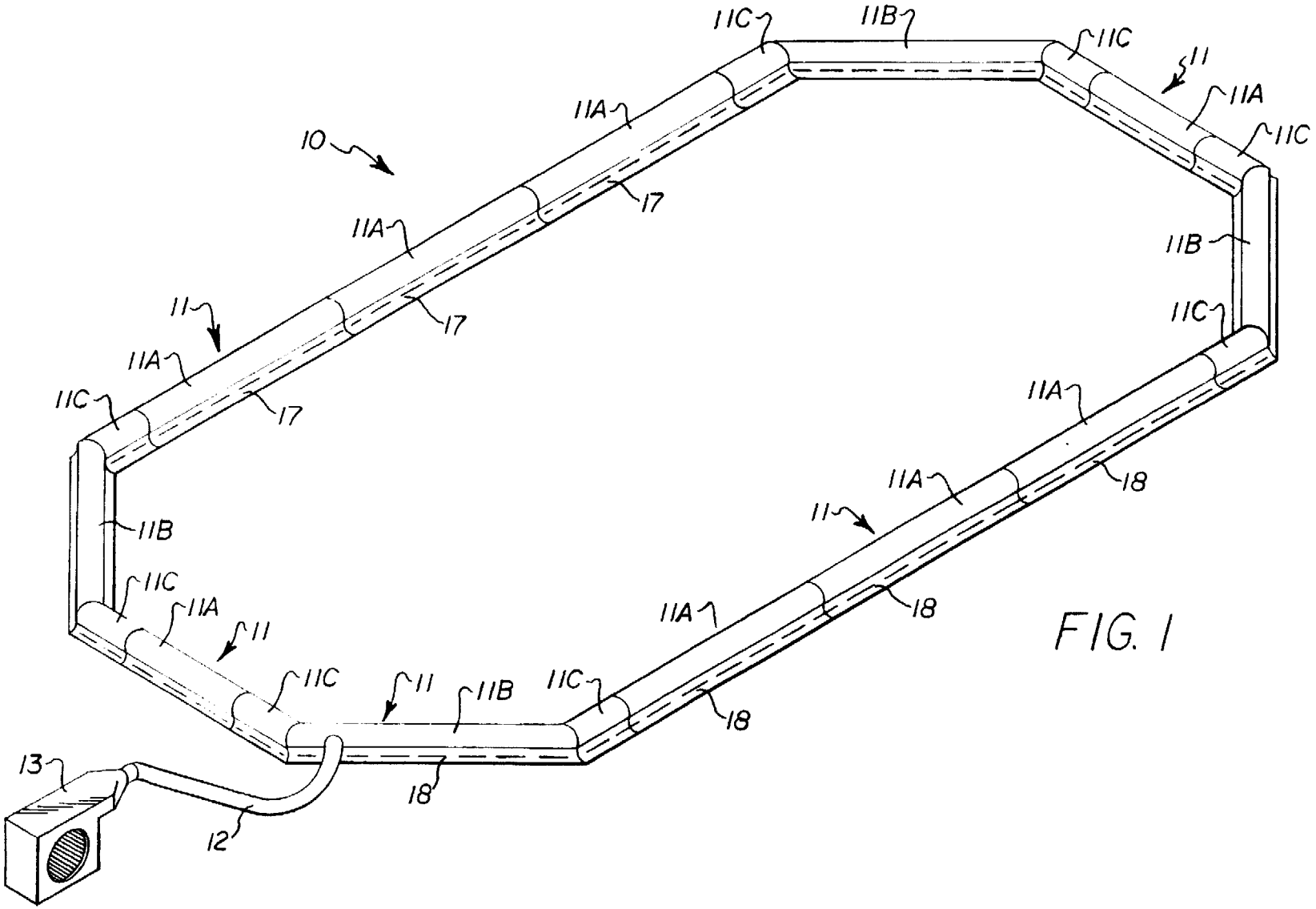
FIG. 1 is a perspective view of the inflatable barrier in accordance with the present invention.

Referring to the drawings by numerals of reference, there is shown in FIG. 1, a preferred inflatable barrier 10 which has been deployed and supported on a generally flat surface to form a continuous configuration of sufficient size and shape to surround the perimeter of the game playing area of a sports game to prevent the ball, puck, or other small object which is used in the game play from being driven a great distance from the playing area. For example, the barrier 10 may be deployed and supported on a flat surface such as a paved parking lot to surround the playing area or "rink" for playing a game of roller hockey or "in-line hockey" and bar passage of the puck or ball.

In the following discussion, roller hockey or "in-line hockey" is used as the example of a suitable sports game, however, it should be understood that the inflatable barrier may be deployed and supported on various other generally flat surfaces such as a field or frozen body of water for playing other games such as field hockey or ice hockey.

In a preferred embodiment for such games, the barrier 10 is a tubular configuration formed of a plurality of elongate hollow tubular members 11 formed of flexible air impervious material such as coated polyester vinyl, or other suitable material, which are releasably joined together end-to-end to form a large continuous configuration of sufficient size and shape to surround the perimeter of the game playing area.

A conduit 12 is connected at one end to one of the tubular members 11 with their interiors in fluid communication and a fan or blower 13 is connected to the free end of the conduit and with a source of power for conducting air into the interior of the joined tubular members 11 to inflate the barrier into a continuous tubular configuration, a one-way valve (not shown) may also be provided between the fan or blower and its connection to the tubular members.

Figure 2:
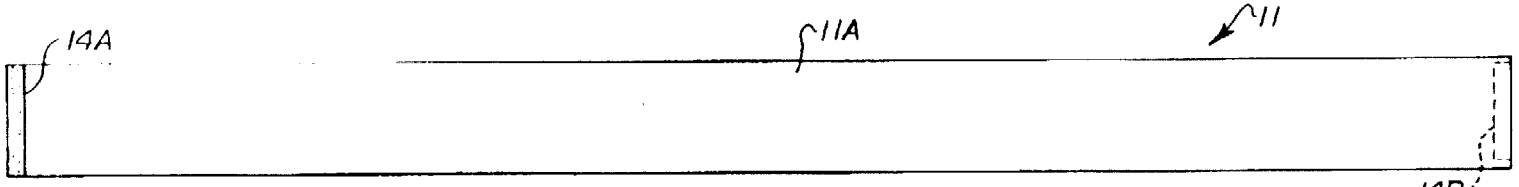
FIG. 2 is a top plan view of a straight tubular member of the inflatable barrier.
Figure 3:
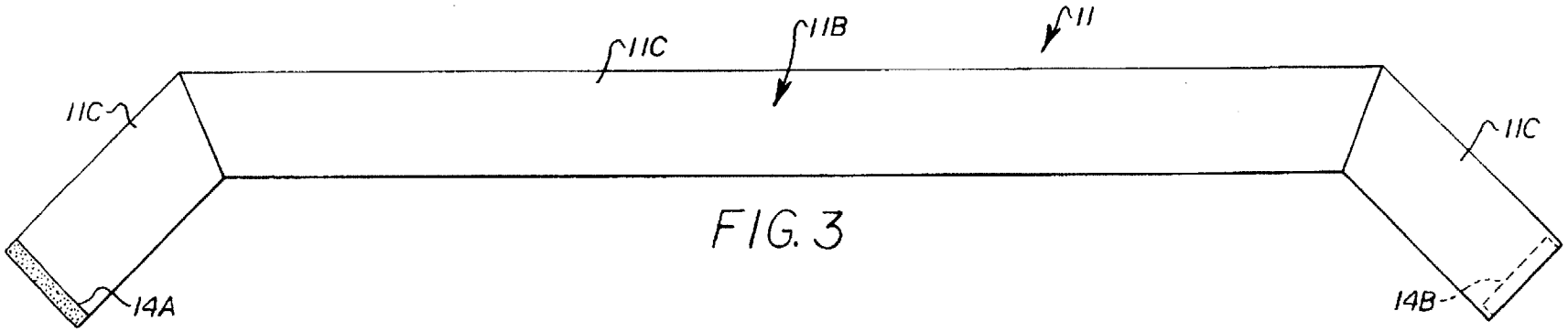
FIG. 3 is a top plan view of a corner tubular member of the inflatable barrier having a straight mid section and angled ends.
Figure 4:
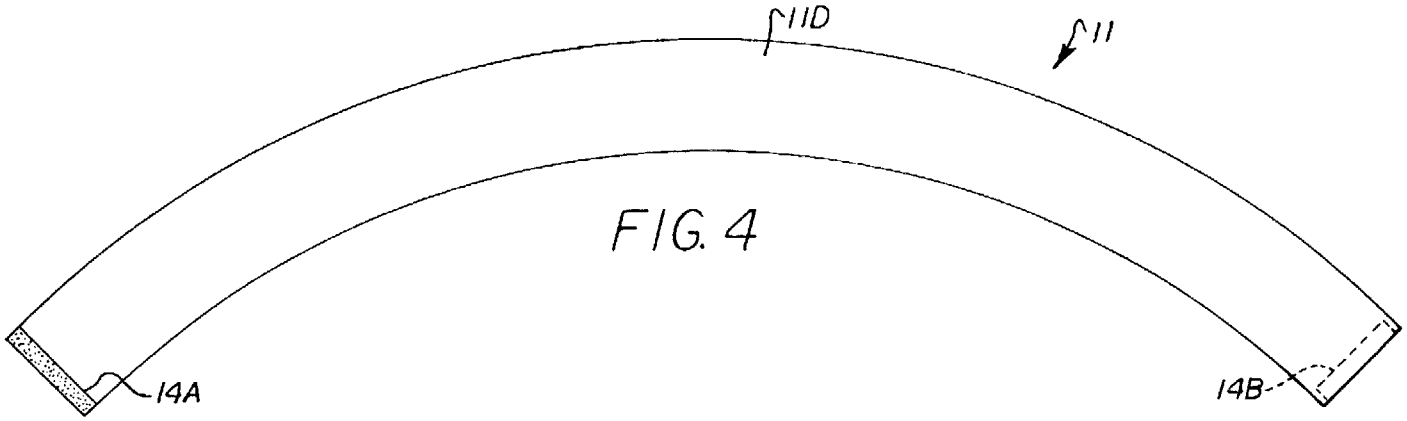
FIG. 4 is a top plan view of a curved corner member of the inflatable barrier which is curved along its longitudinal axis.

FIGS. 2, 3, and 4, illustrate various shapes of tubular members 11 which may be joined end-to-end to form the barrier. FIG. 2 shows a straight tubular member 11A. A plurality of straight tubular members 11A may be joined end-to-end to form a straight side section or end section of the barrier. FIG. 3 shows a tubular member 11B having a straight mid section 11C and opposed end portions 11C which extend angularly from the mid section with respect to its longitudinal axis. These types of tubular members may be joined to the straight tubular members 11A to form the corner sections of the barrier. FIG. 4 shows a curved tubular member lid which is curved along its longitudinal axis. These curved tubular members may also be used to form the corner sections of a barrier.

Figure 5:
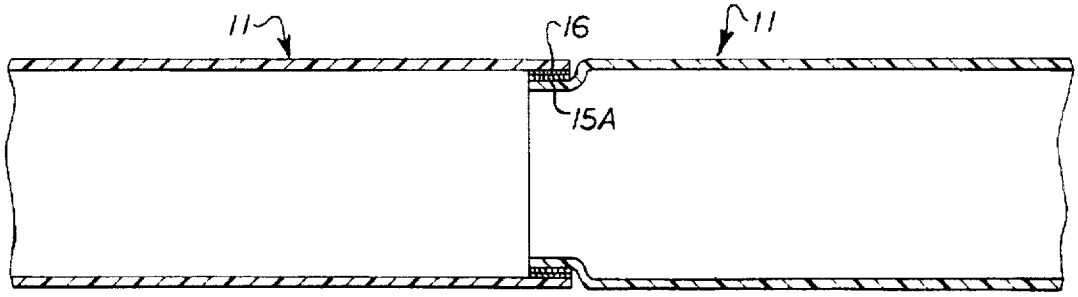
FIG. 5 is a longitudinal cross section through the connection between adjoined tubular members of the inflatable barrier.

Releasable connector means 14A and 14B are provided at each end of the tubular members 11 for joining them together. One preferred connector means is a hook-and-loop fastener arrangement, as best seen in FIG. 5. In this arrangement, a first strip 15 of one element of hook-and-loop fastener material is secured to the exterior diameter of one end of each tubular member, and a second strip 16 of the mating element of hook-and-loop material is secured to the interior diameter of the opposed end of the same said tubular member. The plurality of tubular members may be releasably joined end-to-end by inserting the end of one tubular member bearing the first strip 15 of fastener material into the interior of the end of a tubular member bearing the second strip 16 of fastener material and then manually pressing them together to engage the hook-and-loop fasteners.

It should be understood that other types of releasable connector means may be used. For example, the open ends of the tubular members may be placed face-to-face and a suitable adhesive tape wrapped around the abutted ends. It should also be understood that each end of the tubular members may be reinforced by a rigid wire ring or band to maintain the circular end configuration and facilitate engagement of the connector means.

In the example of FIG. 1, a plurality of the straight tubular members 11A are joined to form the straight sides and end portions of the barrier 10 and four of the tubular members 11B having angled end portions are used to form the corners of the barrier. The tubular members 11 may be provided in various lengths such that when assembled, the barrier will surround the playing area of various sport games.

In the example of a barrier suitable for use in surrounding the playing area or "rink" for in-line hockey in accordance with the specifications of the "National In-line Hockey Association" (N.I.H.A.), a barrier which would accommodate a "Junior rink" would be approximately 60 feet wide and 100 feet in length, and approximately 100 feet wide and 180 feet in length for a "Senior rink". The tubular members 11 would be approximately 18" in diameter.

In a preferred embodiment for in-line hockey, the tubular members 11 are provided in straight sections 11A (FIG. 2) having a length of 40 feet or 80 feet and diagonal 11B or rounded 11D corner sections (FIGS. 3 and 4) which occupy a 10 foot by 10 foot corner. Tubular members in these lengths makes it possible to easily to erect either a "Junior" or "Senior" rink merely by adding or removing several straight sections to the sides and ends of the configuration, thus eliminating the need for a separate "Junior" and "Senior" size barrier. The low profile (18" diameter) of the tubular members 11 provides low wind resistance so that the inflated barrier is not adversely affected by gusts of wind. The relatively small diameter of the tubular members 11 does not require a large volume of air to maintain inflation so that in most installations only a single blower is required.

In a preferred embodiment, the tubular members 11 are provided with an inner flap or skirt arrangement to further aid in reducing passage of the puck, ball, or other small object beyond the boundary and an outer flap or skirt arrangement to more securely anchor the barrier to the supporting surface, as described below.

Figure 6:
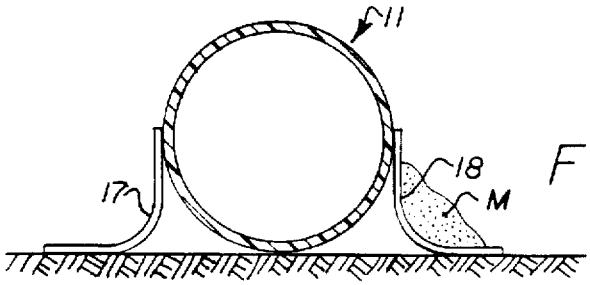
FIG. 6 is a transverse cross section through a tubular member of the inflatable barrier.
Figure 7:
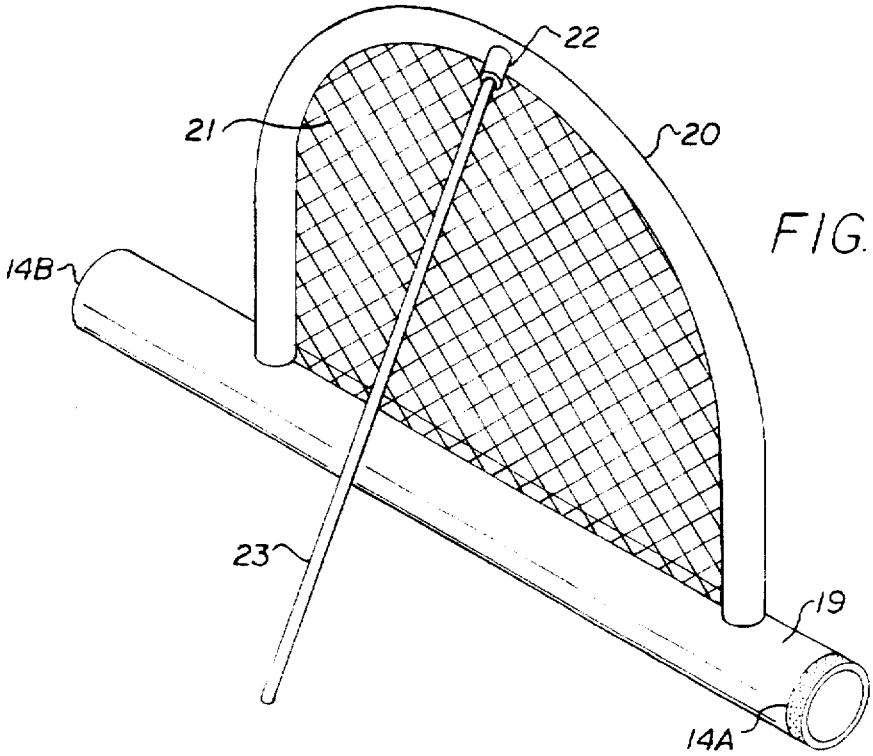
FIG. 7 is a perspective view of a tubular member of the inflatable barrier having a net arrangement.

Referring now to FIG. 6, a tubular member 11 is shown supported on a generally flat supporting surface S. An elongate rectangular inner skirt 17 formed of flexible material is secured along one longitudinal edge to the exterior of each tubular member 11 along its length on one side thereof. This would be the side which faces the playing area. The inner skirt 17 is of sufficient width in a transverse direction such that its opposed free longitudinal edge extends generally vertically downward from the tubular member 11 and rests on the generally flat supporting surface S when the tubular members are joined together and inflated. After assembly and inflation, adjacent inner skirts 17 are disposed in an end-to-end relation to form a generally continuous skirt facing the game playing area.

The tubular members may also be provided with an outer skirt 18 to more securely anchor the barrier to the supporting surface S. The outer skirt 18 is a elongate rectangular member formed of flexible material having one longitudinal edge secured to the exterior surface of each tubular member 11 along its length on the outwardly facing side thereof and is of sufficient width in a transverse direction such that its lower portion and its opposed free longitudinal edge extends generally vertically downward and rests on the generally flat supporting surface S. After the tubular members are joined together and inflated, adjacent outer skirts 18 are disposed in an end-to-end relation to form a generally continuous skirt on the exterior of the barrier. Various materials M may then be placed on the lower portion of the outer skirts 18 to anchor the barrier to the supporting surface S. It should be understood that the lower end of the outer skirt 18 may be provided with grommets along its length through which tent stakes may be driven to anchor the barrier.

Figure 8:
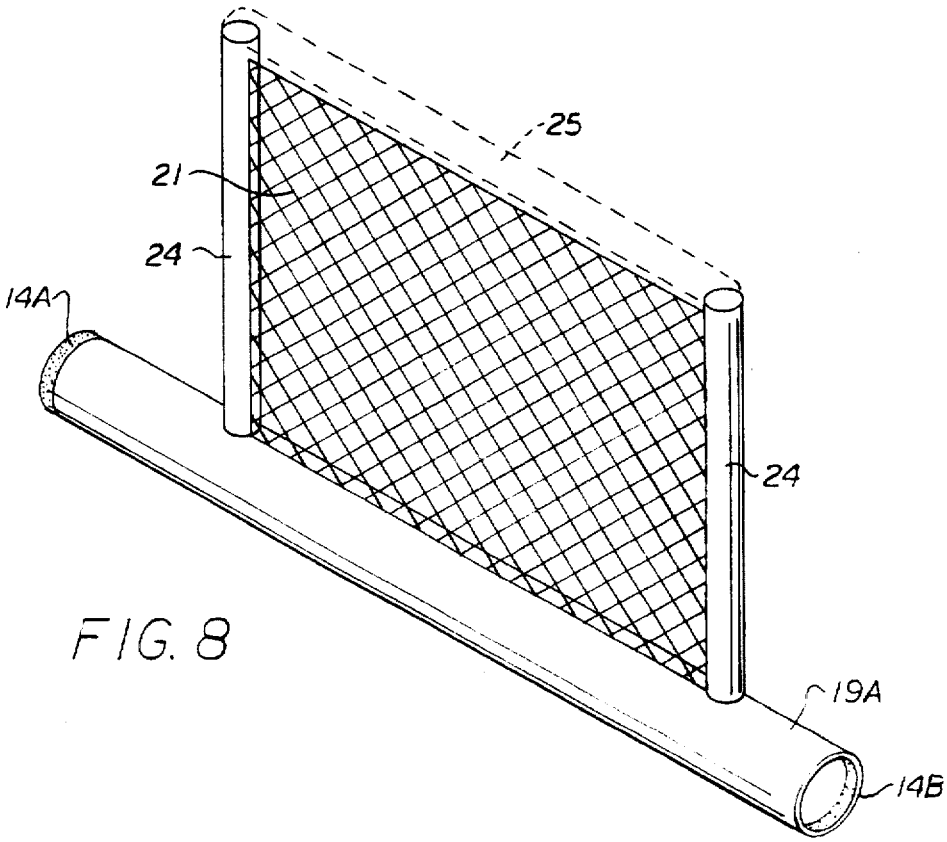
FIG. 8 is a perspective view of a tubular member of the inflatable barrier having an alternate net arrangement.

The barrier 10 may also be provided with a net arrangement at each end or at other locations for catching the puck, ball or other small object which may be propelled to a height greater than the height of the tubular members 11. FIG. 8 shows one type of net arrangement. In this arrangement, a tubular member 19 formed of the flexible air impervious material and having the end connection means 14A and 14B as described previously, has an arcuate inflatable tubular member 20 formed of the flexible air impervious material joined at each end to the tubular member 19 with their interiors in fluid communication. A length of netting material 21 is secured across the opening between the tubular members 19 and 20. When the tubular barrier is inflated, the arcuate tubular member 20 also becomes inflated to extend outwardly and upwardly from the tubular member 19.

The arcuate tubular member 20 may also be provided with a receptacle 22 on the outward facing surface of its side wall for receiving one end of an elongate pole or rod 23. The opposite end of the pole or rod 23 may be placed on the ground surface such that the upper portion of the tubular member is supported and maintained in the upstanding position to resist deflection and bending in strong wind conditions, etc.

FIG. 8 shows another embodiment of a net arrangement. In this arrangement, a tubular member 19A formed of the flexible air impervious material and having the end connection means 14A and 14B as described previously, has a plurality of spaced apart inflatable tubular column members 24 formed of the flexible air impervious material joined thereto with their interiors in fluid communication. The column members 24 may be closed at their outer ends as shown in the illustration, or may be joined in fluid communication by a horizontal tubular member 25 (dashed lines) to form of a wide generally square inverted U-shape with each end joined in fluid communication with the interior of the tubular member 19A. When the tubular members of the are joined together and inflated, the column members 24 and horizontal member also become inflated to extend outwardly and upwardly from the tubular member. A length of netting material 21 is secured at its laterally opposed ends to the column members 24 to extend therebetween. The netting material 21 may also be secured along its bottom edge to the tubular member 19A and along its top edge to the horizontal member 15 (shown in dashed lines).

It should be understood that a plurality of the tubular members with the netting may be joined together to form a fence-like barrier. It should also be understood that the barrier has been described using tubular members having a circular cross section as an example, however other hollow barrier members formed of flexible air impervious material may used which have a different cross section.

Figure 9:
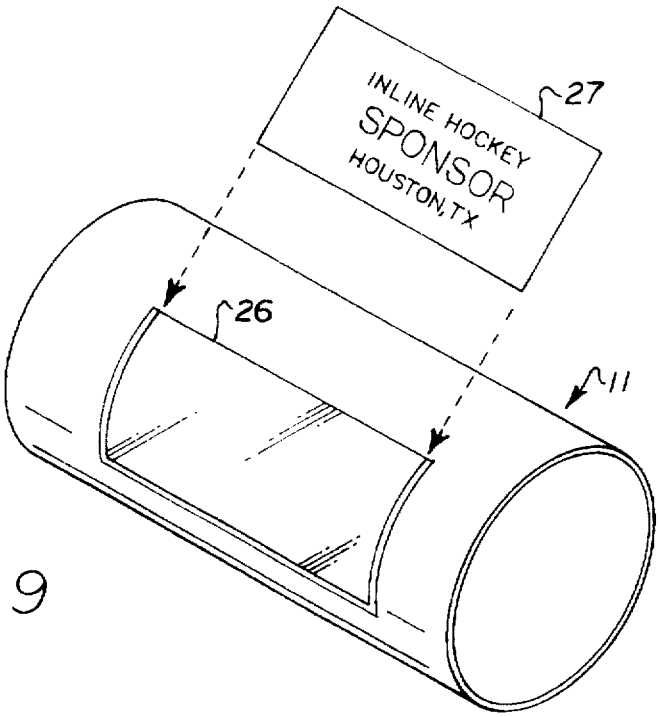
FIG. 9 is a perspective view of a tubular member having a transparent envelope on its exterior which receives a flexible panel bearing advertising or sponsor indicia.

As shown in FIG. 9, the elongate tubular members 11 may be provided with a rectangular strip of thin flexible transparent plastic material secured along three edges to the exterior surface of the tubular member to form a transparent envelope 26. A flexible sheet or panel 27 bearing advertising or sponsor indicia is slidably received in the envelope 26 and is firmly maintained therein when the tubular members are inflated.

OPERATION

The tubular members in their deflated and unassembled condition, are flat, flexible, and lightweight and may be rolled up like a fire hose, or may be folded to form a series of small compact units which are easily transported in the trunk of an automobile or small pickup truck and occupy a small area when stored.

To deploy the barrier, tubular members are unrolled or unfolded and laid out end-to-end in a flattened condition to surround the playing area. The adjacent ends of the tubular members are then joined together to form a continuous configuration. The free end of the air supply conduit is connected to the fan or blower, and the blower is turned on to inflate the continuous tubular barrier. The fan or blower may be allowed to run continuously to maintain the inflated configuration.

After the game, the fan or blower is turned off and the inflated barrier deflates to resume the flattened condition as the end connections are unfastened. After the tubular members have been disconnected they may then be rolled up like a fire hose, or may be folded to form a series of small compact units which are easily transported in the trunk of an automobile or small pickup truck back to the storage area.

While this invention has been described fully and completely with special emphasis upon a preferred embodiment, it should be understood that within the scope of the appended claims the invention may be practiced otherwise than as specifically described herein.

I claim:

1. An inflatable barrier for sports games comprising:

an elongate hollow barrier member formed of a a plurality of elongate hollow barrier members formed of flexible air impervious material joined end-to-end supported on a generally flat surface to form a continuous configuration of sufficient size and shape to surround the perimeter of a game playing area; and conduit means on said hollow barrier member adapted to be connected with a source of air for conducting air into the interior of said hollow barrier members to inflate them;

said continuous configuration in the inflated condition supported on said generally flat surface defining a perimeter barrier surrounding said game playing area to bar passage of small objects traveling across said generally flat surface.

2. The inflatable barrier according to claim 1 further comprising connector means at each end of each said elongate hollow barrier member for releasably joining said plurality of elongate hollow barrier members end-to-end to form said continuous configuration.

3. The inflatable barrier according to claim 2 in which said connector means at each end of each said elongate hollow barrier member comprises mating strips of hook-and-loop fastener material.

4. The inflatable barrier according to claim 3 in which said mating strips of hook-and-loop fastener material comprise a first strip of one element of hook-and-loop fastener material secured to an exterior surface of one end of each said elongate hollow barrier member, and a second strip of a mating element of hook-and-loop material secured to an interior surface of the opposed end of the same said elongate hollow barrier member;

said plurality of elongate hollow barrier members being releasably joined end-to-end by inserting the exterior surface of one elongate hollow barrier member bearing said first strip of fastener material into the interior surface of the end of an adjacent elongate hollow barrier member bearing said second strip of fastener material and engaging said hook-and-loop fasteners.

5. The inflatable barrier according to claim 1 in which said plurality of elongate hollow barrier members comprise a plurality of straight barrier members.

6. The inflatable barrier according to claim 1 in which said plurality of elongate hollow barrier members comprise a plurality of hollow barrier members having a straight mid section and opposed end portions which extend angularly from said mid section with respect to a longitudinal axis.

7. The inflatable barrier according to claim 1 in which said plurality of elongate hollow barrier members comprise a plurality of curved hollow barrier members which are curved along a longitudinal axis.

8. The inflatable barrier according to claim 1 further comprising:

at least one elongate hollow barrier member formed of flexible air impervious material;

a pair of laterally spaced inflatable tubular column members formed of flexible air impervious material joined to said at least one elongate hollow barrier member in fluid communication therewith to extend outwardly and upwardly therefrom in an inflated condition; and a length of netting material extending between said tubular column members.

9. The inflatable barrier according to claim 1 further comprising inflation means connected with said conduit means and with a source of power for inflating said elongate hollow barrier member.

10. The inflatable barrier according to claim 1 in which said elongate hollow barrier members are elongate tubular member formed of flexible air impervious material.

11. The inflatable barrier according to claim 10 in which said elongate tubular members are formed of flexible air impervious material joined end-to-end to form said continuous configuration.

12. The inflatable barrier according to claim 11 further comprising connector means at each end of each said tubular member for releasably joining said plurality of tubular members end-to-end to form said continuous configuration.

13. The inflatable barrier according to claim 12 in which said connector means at each end of each said tubular member comprises mating strips of hook-and-loop fastener material.

14. The inflatable barrier according to claim 13 in which said mating strips of hook-and-loop fastener material comprise a first strip of one element of hook-and-loop fastener material secured to the exterior diameter of one end of each said tubular member, and a second strip of a mating element of hook-and-loop material secured to the interior diameter of the opposed end of the same said tubular member;

said plurality of tubular members being releasably joined end-to-end by inserting the end of one tubular member bearing said first strip of fastener material into the interior of the end of an adjacent tubular member bearing said second strip of fastener material and engaging said hook-and-loop fasteners.

15. The inflatable barrier according to claim 11 in which said elongate tubular members are formed of vinyl material.

16. The inflatable barrier according to claim 11 in which said plurality of elongate tubular members comprise a plurality of straight tubular members.

17. The inflatable barrier according to claim 11 in which said plurality of elongate tubular members comprise a plurality of tubular members having a straight mid section and opposed end portions which extend angularly from said mid section with respect to a longitudinal axis.

18. The inflatable barrier according to claim 11 in which said plurality of elongate tubular members comprise a plurality of curved tubular members which are curved along a longitudinal axis.

19. The inflatable barrier according to claim 11 further comprising:

at least one elongate tubular member formed of flexible air impervious material;

a pair of laterally spaced inflatable tubular column members formed of flexible air impervious material joined to said at least one elongate hollow barrier member in fluid communication therewith to extend outwardly and upwardly therefrom in an inflated condition; and a length of netting material extending between said tubular column members.

* * * * *